United States Patent [19]

Lee

[11] Patent Number: 5,050,713

[45] Date of Patent: Sep. 24, 1991

[54] TRAVEL BAG

[75] Inventor: Robert M. Lee, Reno, Nev.

[73] Assignee: Hunting World, Incorporated, Sparks, Nev.

[21] Appl. No.: 478,420

[22] Filed: Feb. 12, 1990

[30] Foreign Application Priority Data

Feb. 13, 1989 [IT] Italy ..... 20568 B/89

[51] Int. Cl.[5] ..... A45C 13/10; A45C 13/26

[52] U.S. Cl. ..... 190/108; 190/116; 150/110; 150/111; 383/37

[58] Field of Search ..... 190/108, 109–111, 190/102, 116; 150/111, 113; 383/37, 9; 224/32 A; 220/23.4

[56] References Cited

U.S. PATENT DOCUMENTS

| | | | |
|---|---|---|---|
| 199,229 | 1/1878 | Scheuer . | |
| 1,900,508 | 3/1933 | Lewis | 190/111 X |
| 2,707,035 | 4/1955 | Lashley | 190/108 X |
| 2,813,602 | 11/1957 | MacArthur, Jr. | 190/108 X |
| 3,085,612 | 4/1963 | Gobel | 383/37 X |
| 4,424,841 | 1/1984 | Smith | 190/108 X |
| 4,431,041 | 2/1984 | Leiserson | 190/110 X |
| 4,580,706 | 4/1986 | Jackson et al. | 224/32 A |
| 4,620,579 | 11/1986 | Lowe et al. | 190/110 X |
| 4,744,446 | 5/1988 | Arney | 190/110 X |

FOREIGN PATENT DOCUMENTS

| | | | |
|---|---|---|---|
| 3600794 | 8/1986 | Fed. Rep. of Germany | 190/110 |
| 855081 | 5/1940 | France | 150/11 |
| 1452648 | 9/1966 | France | 190/111 |
| 647248 | 10/1962 | Italy | 150/113 |
| 2549 | of 1910 | United Kingdom | 190/111 |
| 1473895 | 5/1977 | United Kingdom | 383/9 |

*Primary Examiner*—Sue A. Weaver

*Attorney, Agent, or Firm*—Cooper & Dunham

[57] ABSTRACT

A saddle-like travel bag which comprises at least two structurally independent and separately usable pouches securely but releasably interconnected in back-to-back relation to each other by fasteners respectively attached to the two pouches. In this way, both the carrying capacity and the aesthetic features of the bag may be varied as desired.

12 Claims, 3 Drawing Sheets

TRAVEL BAG

BACKGROUND OF THE INVENTION

This invention relates to a saddlebag-like travel bag, arranged to be carried as a shoulder bag or handbag and capable of being separated into two smaller independent bags.

Shoulder bags, i.e. bags of the type having a strap to enable the bag to be suspended from a person's shoulder, are widely used to hold personal effects or the like, and as "carry-on" luggage for air travelers. Frequently, it is desirable to have bags of different sizes and capacities available for use on different occasions. A traveler, for example, may wish to have a relatively large-capacity bag to serve as hand luggage on an airplane, and one or more smaller bags to carry on the street or to business or social functions upon reaching the destination.

Heretofore, to meet these diverse requirements it has been necessary for the traveler to bring with him or her plural separate bags of different sizes. This is disadvantageous from the standpoint of desired minimization of space and weight of articles to be packed for a trip. In addition, a traveller will often wish to have more than one of the smaller bags, differing from each other in style and/or accessories to suit different specific environments of use (e.g. daytime sports wear and evening social wear), a consideration that still further increases the size and weight of baggage to be packed.

SUMMARY OF THE INVENTION

The present invention broadly contemplates the provision of a travel bag comprising at least two structurally independent pouches which may be used separately but are detachably yet securely interconnected in back-to-back relation by interengageable fastening means respectively attached to the two bags, thereby to enable them to be carried (e.g. by a shoulder strap) as a unit constituting a single bag.

In currently preferred embodiments, the fastening means are arranged to be adjusted and/or concealed upon separation of the two pouches so that each separate pouch has a complete and finished appearance. Additionally, the two pouches, though complementing each other in design (so as to constitute, when joined, a stylistically integral entity), may be specifically different from each other in features of configuration, styling detail, and/or accessory elements.

The bag of the invention has the advantages that it can be adjusted to suit one's carrying capacity and changed aesthetically by using the pouches which comprise it either jointly together or separately.

Further features and advantages of the invention will be apparent from the detailed description hereinbelow set forth, together with the accompanying drawings.

DETAILED DESCRIPTION

Figure 1:
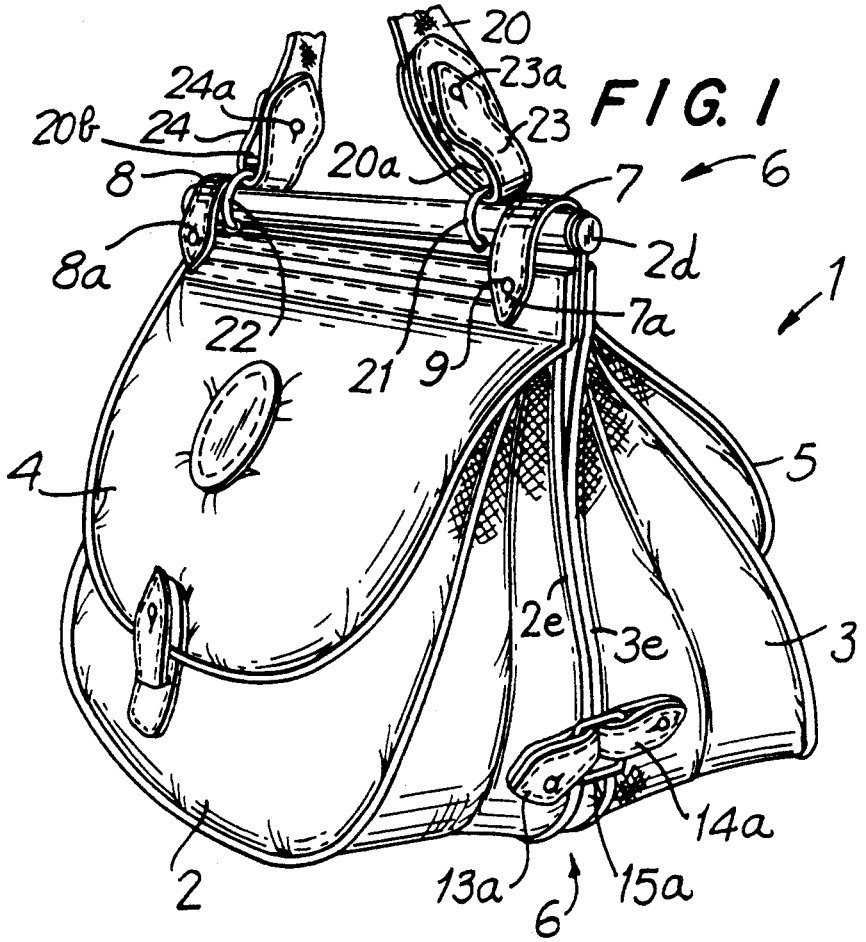
FIG. 1 is a perspective view of a travel bag constituted of two pouches and embodying the invention in a particular form.

In the drawings, the invention is illustrated (by way of specific example) as embodied in a travel bag 1 comprising a pair of pouches 2 and 3, which are structurally independent of each other.

The pouches 2 and 3 have front closure flaps respectively designated 4 and 5. As in conventional saddlebags, the front closure flap of each pouch is flexibly secured to the top of the back wall of the pouch, and extends across the pouch opening and down over the front wall of the pouch, to which it is secured by a suitable fastener such as the tab-and-button fastener 4*a* of the pouch 2.

In accordance with the invention, the two pouches 2 and 3 are securely yet detachably held together, in back-to-back relation to each other, by fastening means generally indicated at 6. As shown, the top of the back wall of each pouch is formed as a flat horizontally extending bar 2*a* or 3*a*, having a vertical rearwardly-facing surface, extending across the width of the pouch; when the two pouches are interconnected to form the bag 1, the rearwardly-facing surfaces of their respective bars 2*a* and 3*a* are pressed together in register with each other.

The fastening means 6 include a pair of strips of fastening elements 2*b* and 3*b* respectively comprising a multiplicity of flexible loops and a multiplicity of flexible hooks interengageable with the loops, such strips being of the type commercially available under the trade name "Velcro." These strips 2*b* and 3*b* are respectively mounted on the aforementioned rearwardly-facing surfaces of the bars 2*a* and 3*a*, in such positions that they interengage when the two bars are pressed together in the assembled bag.

Above the bar 2*a* of the bag 2 there is mounted a rigid rod 2*d*, extending parallel to the bar 2*a* and laterally surrounded and secured by material of the pouch and/or the bar. The rod 2*d* remains attached to the pouch 2 when the two pouches are separated. There is no such rod on the pouch 3; thus, the presence or absence of the rod constitutes a difference in styling detail between the two pouches.

The fastening means 6 also includes a first pair of straps 7, 8 bridging the joint between the pouches 2 and 3 at the top of the bag, respectively adjacent opposite sides of the bag. Each of the straps 7 and 8 is secured at one end to the pouch 2 and at the other end to the pouch 3, at least one of the points of securement of each strap being detachable. In the form shown, the straps are removably associated with the pouches by means of a button-like type of coupling.

Figure 4:
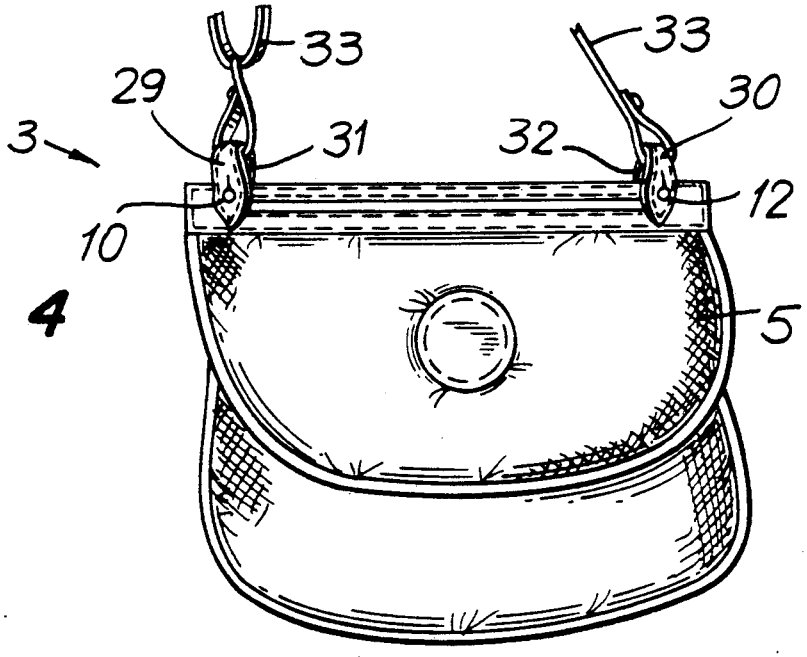

More particularly, in the illustrated embodiment of the invention one end of the strap 7 has a buttonhole 7*a* which receives a button or button-like element 9, mounted on the forwardly-facing surface of the bar 2*a* of pouch 2, and the other end of strap 7 has a buttonhole 7*b* which receives a button or button-like element 10 mounted on the forwardly-facing surface of the bar 3*a* of pouch 3 (FIG. 4). Similarly, one end of the strap 8 has a buttonhole 8*a* which receives a button or button-like element 11 mounted on the forwardly-facing surface of the bar 2*a* of pouch 2, and the other end of strap 8 has a buttonhole 8*b* which receives a button or button-like element 12 mounted on the forwardly-facing surface of the bar 3*a* of pouch 3 (FIG. 4). As thus mounted, the straps 7 and 8 extend over the rod or handle 2*d* on opposite sides of the bag 1 to cooperate with the strips 2*b* and 3*b* in holding the tops of the pouches 2 and 3 together with the pouches in back-to-back relation. The straps 7 and 8 can be detached (by unbuttoning) from either or both of the pouches when the pouches are to be separated.

The fastening means 6 further includes two pairs of tongues, respectively designated 13*a*, 14*a* and 13*b*, 14*b*, and respectively extending from lower portions of the rear side edges 2*e*, 3*e*, 2*f*, and 3*f* of the pouches 2 and 3. As more particularly shown in FIGS. 1 and 2, the tongue 13*a* is anchored to the seam formed along one rear side edge 2*e* of the pouch 2, and has a buttonhole 13*c* in its free end for receiving a button 16 mounted on a tab 16*a* secured to the side of pouch 2 adjacent tongue 13*a*. Similarly, the tongue 14*a* is anchored to the seam formed along the rear side edge 3*e* of the pouch 3 (in register with the tongue 13 when the two pouches are assembled back-to-back as in FIG. 1), and has a buttonhole 14*c* in its free end for receiving a button 17 mounted on a tab 17*a* secured to the side of pouch 3 adjacent tongue 14*a*. Tongues 13*b* and 14*b* are arranged in like manner, with associated buttonholes, buttons and tabs (not shown in FIGS. 1 and 2) on the opposite side of the bag 1.

The tongues 13*a*, 14*a* and 13*b*, 14*b* serve to hold the sides of the pouches 2 and 3 together, at their lower portions, by releasable engagement with ring links 15*a* and 15*b*, respectively, which essentially act as leaders for the tongues. In the illustrated embodiment, tongue 13*a* is threaded through ring link 15*a*, which is entrapped in the bight of the latter tongue when the button 16 is inserted in buttonhole 13*c*; tongue 14*a* is similarly threaded through the same link 15*a*, so that the link interconnects the tongues 13*a* and 14*a* when the button 17 is received in button-hole 14*c*. Ring link 15*b* provides a like releasable interconnection between tongues 13*b* and 14*b* on the other side of the bag.

The bag 1 has a carrying handle or shoulder strap 20 which, in accordance with one aspect of the invention, is advantageously a handle both for the bag and for the pouch 2 when the latter is used separately. The handle 20, moreover, is associated with the pouch 2 in a removable manner; to that end, it is formed at its opposite ends into bights 20*a*, 20*b* which engage, in turn, removably with rings 21, 22 attached to the pouch 2 adjacent opposite sides of the top of the pouch. Such bights are advantageously formed by folding over, on the handle 20, tongues 23, 24 which extend from the handle ends and are secured by buttons 23*a*, 24*a*.

Figure 2:
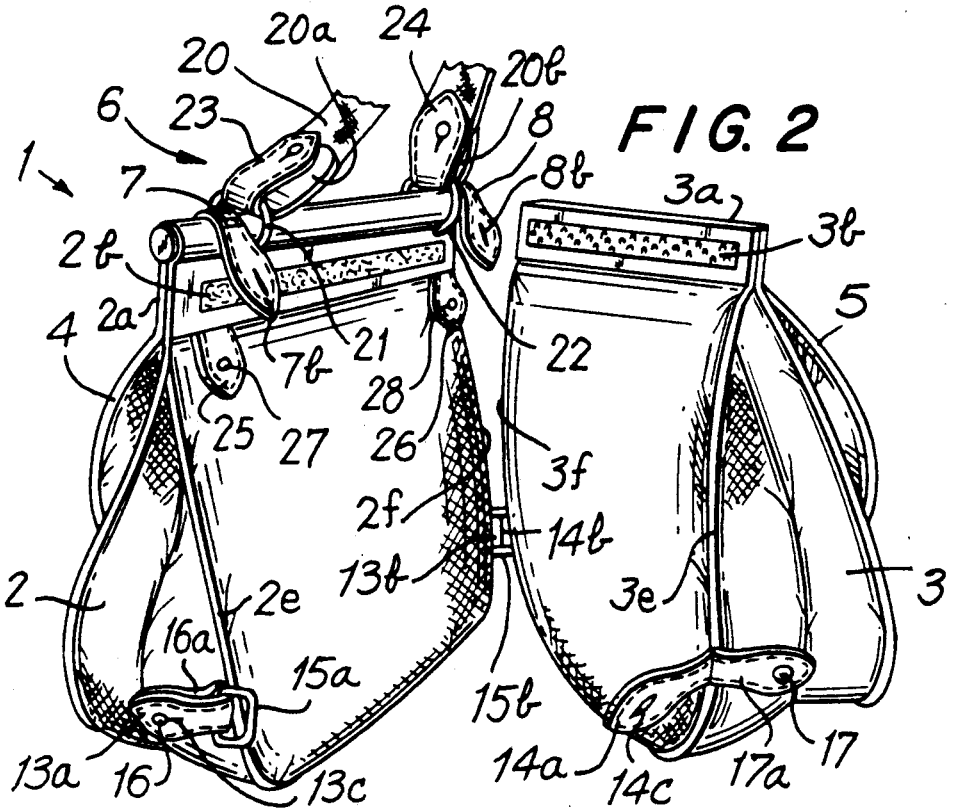
FIG. 2 is an exploded perspective view of the bag shown in FIG. 1.
Figure 3:
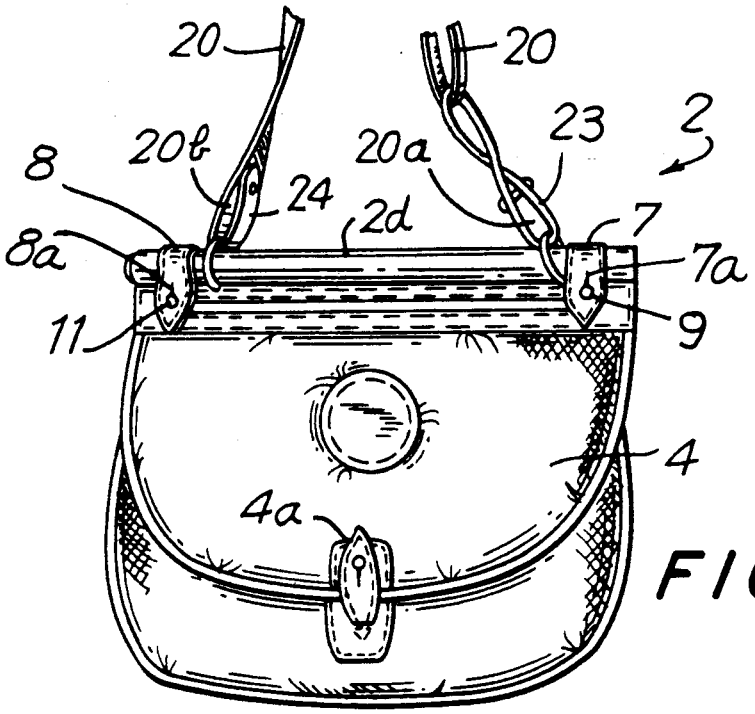
FIGS. 3 and 4 are, respectively, front elevational views of the two pouches of the bag shown in FIG. 1.

As shown in FIG. 2, the pouch 2 is provided rearwardly with a pair of tongues 25, 26 having respective buttons 27, 28 disposed and arranged to engage with the buttonholes 7*b*, 8*b* of the straps 7, 8 when the two pouches are separated, to provide a finished appearance for the separated pouch 2. The pouch 3 of the bag 1 (see FIG. 4) is provided with fittings for separate use which comprise, for example, a pair of straps 29, 30 and a carrying handle or shoulder strap 33; the straps are removably mountable on the buttons 10, 12 projecting from the front of the pouch 3, so as to define respective bights 31, 32 constituting respective leaders for releasable engagement with the opposite ends of the handle 33 for carrying the pouch 3. The handle 33 engages with the bights 31 and 32 in a manner quite similar to that previously described in relation to the handle 20.

Figure 5:
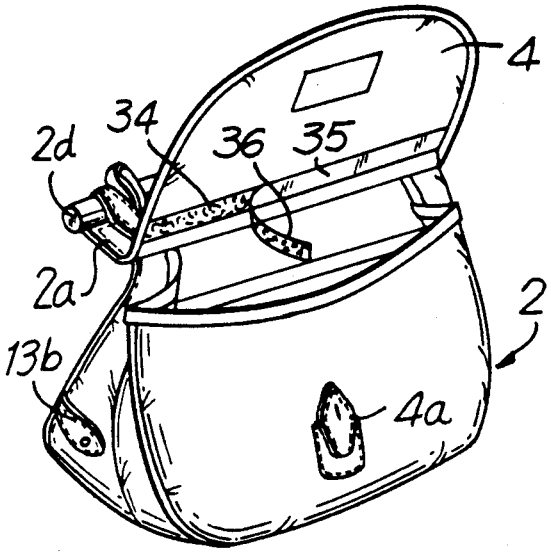
FIGS. 5 and 6 are perspective views illustrating successive stages in the adjustment of the pouch of FIG. 3 after separation from the pouch of FIG. 4.
Figure 6:
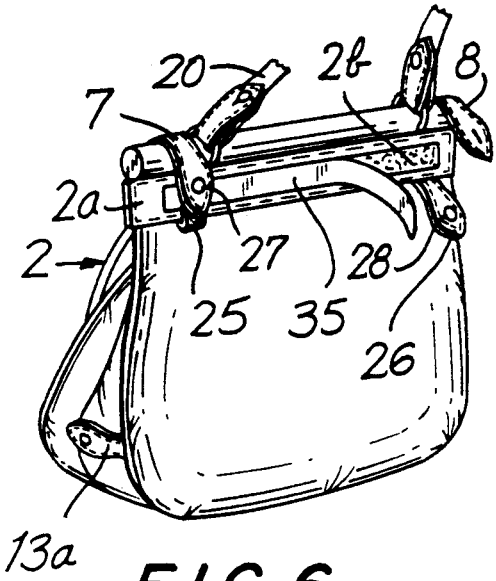
Figure 7:
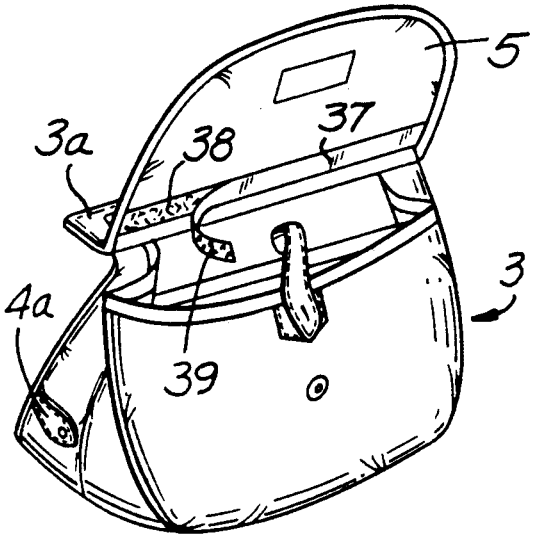
FIGS. 7 and 8 are similar perspective views illustrating successive stages in the adjustment of the pouch of FIG. 4 after separation from the pouch of FIG. 3.
Figure 8:
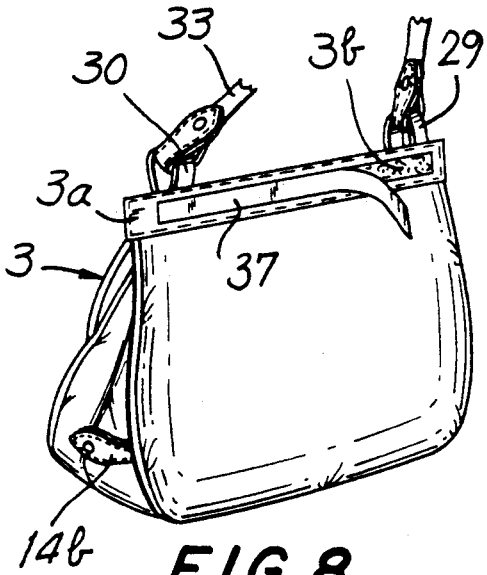

Referring to FIGS. 5 and 6, a strip 34 of the same flexible elements as strip 2*b* is mounted on the inner surface of the front flap 4 of pouch 2, and a leather or like band 35 bearing a strip 36 of the same flexible element material as strip 3*b* is removably secured thereto, i.e. by interengagement of strips 34 and 35. When the two pouches are separated, the band 35 is detached from the front flap 4 and removably secured (by means of strip 36) to the strip 2*b* on the rearwardly facing surface of bar 2*a*, to provide a finished appearance for the separated pouch. A like band 37 (FIGS. 7 and is removably mounted inside the front flap 5 of pouch 3, by means of strips 38 and 39 respectively constituted of the same flexible element material as strips 2*a* and 3*b* for covering the strip 3*b* on the exterior of pouch 3 when the pouches are separated.

To use the pouches 2 and 3 of the bag 1 in the separate mode, one proceeds as follows:

Grasping the ends of the straps 7, 8, the latter are disengaged from the buttons 10 and 12 of the pouch 3, whereby the pouch 3 is released from the pouch 2 opposite to it along the top. The subsequent operation of releasing the pouch sides is then performed by unbuttoning one of the opposed tongues 13*a*, 14*a* (for example tongue 14*a*) to cause it to become disengaged from its respective button 16 or 17, and slipping the free end of the unbuttoned tongue off its associated ring link 15*a* to release the two pouches along one side. The bag will thus be in the condition shown in FIG. 2. A similar operation is then performed on the opposite side of the bag at the: side tongues 13*b* and 14*b* which extend from the edges 2*f* and 3*f*. Finally, the two pouches are pulled apart to disengage the strips 2*b* and 3*b* from each other, completing the separation of the pouches.

After separation, the tongues 14*a* and 14*b* are reattached to their associated buttons. Should one wish, for aesthetic reasons, to remove the ring links 15*a* and 15*b* from the pouch 2 (FIG. 2), this can be done by just disengaging the tongues 13*a* and 13*b* from their associated buttons, pulling out the ring links, and re-attaching the free ends of the tongues to the pouch. To enhance the aesthetic appearance of the pouch 2, the straps 7, 8 may be advantageously fastened, following removal from the buttons 10, 12 of the pouch 3, to the buttons 27, 28 which extend from the rear tongues 25 and 26. The bands 35 and 37 are removed from the inner surfaces of the front flaps 4 and 5 to cover the strips 2*b* and 3*b*.

The pouches 2 and 3 of the bag moreover, may be carried conveniently either by holding them directly with one hand or by means of the handles 20 and 33. Where one wishes to carry the pouch 2 by grasping it with one hand, removal of the handle 20 can be quickly effected in a simple manner by disengaging the tongues 23, 24 from the handle and slipping them off the rings 21 and 22 attached to the pouch. On the other hand, where one wishes to carry the pouch 3 by the handle 33, the latter is attached to the pouch by folding over and fastening the straps 29 and 30 to the buttons 10 and 12 so as to form the bights 31 and 32. Each bight is then associated, in much the same manner as with the handle 20, with the opposite ends of the handle 33 to thereby secure the handle to the pouch.

Thus, the bag 1 of this invention can have both its carrying capacity and its aesthetic features changed to suit the user's preference. It should be noted that the pouch 2 is advantageously provided with a handle which is also the bag handle. When the pouches are to be used separately, they may be carried by their handles or without them since these may be attached to and removed from the pouches as desired.

It is to be understood that the invention is not limited to the features and embodiments hereinabove set forth but may be carried out in other ways without departure from its spirit. Thus, as an example, the fastening means 6 may be a different design and comprise some other closure arrangements already known in the art and commonly employed with travel equipment and leather articles, such as snap buttons, buckles, pull-apart closure devices, etc.

I claim:

1. A travel bag comprising:
(a) two structurally independent and separately usable pouches each having a back wall with a top formed as a horizontally extending bar; and
(b) means for securely yet detachably interconnecting said pouches in back-to-back relation to each other, said interconnecting means including
(i) first interengageable fastening means having portions respectively attached to the two pouches for holding the respective bars of the two pouches together and
(ii) second interengageable fastening means having portions respectively attached to the two pouches for holding the lower portions of the two pouches together, said second fastening means comprising at least two tongues interconnecting the sides of said pouches by passing through a ring link.

2. A travel bag according to claim 1, wherein said first fastening means comprises straps.

3. A travel bag according to claim 2, wherein said first fastening means includes coupling means comprising a pair of buttons attached to one of the two pouches and a pair of said straps connected to the other of the pouches, said straps bridging the joint between said pouches and being attached releasably to said buttons.

4. A travel bag according to claim 1, wherein at least one of said pouches is provided with a handle also forming a carrying handle for said travel bag.

5. A travel bag comprising:
(a) two structurally independent and separately usable pouches each having a back wall with a top formed as a horizontally extending bar; and
(b) means for securely yet detachably interconnecting said pouches in back-to-back relation to each other, said interconnecting means including
(i) first interengageable fastening means having portions respectively attached to the two pouches for holding the respective bars of the two pouches together, said first fastening means comprising a first strip of flexible loops and a second strip of flexible hooks releasably interengageable with said loops, respectively mounted on facing portions of said pouches for engagement with each other, and
(ii) second interengageable fastening means having portions respectively attached to the two pouches for holding the lower portions of the two pouches together.

6. A travel bag according to claim 5, wherein each of said pouches has an inner surface, and further including a pair of bands respectively having means manually applicable to said strips for engaging and covering said strips when said pouches are separated, and means disposed on said inner surfaces of said pouches for respectively releasably carrying said bands such that the bands can be manually removed from the pouch inner surfaces and applied to the strips upon separation of the pouches.

7. A travel bag as defined in claim 5, wherein said first fastening means further includes a pair of straps attached to one of said pouches respectively adjacent opposite sides of the top thereof, and releasably attached to the other of said pouches respectively adjacent opposite sides of the top thereof.

8. A travel bag comprising:
(a) two structurally independent and separately usable pouches each having a back wall with a top formed as a horizontally extending bar; and
(b) means for securely yet detachably interconnecting said pouches in back-to-back relation to each other, said interconnecting means including
(i) first interengageable fastening means having portions respectively attached to the two pouches for holding the respective bars of the two pouches together, said first fastening means including a pair of straps attached to one of said pouches respectively adjacent opposite sides of the top thereof, and releasably attached to the other of said pouches respectively adjacent opposite sides of the top thereof, and
(ii) second interengageable fastening means having portions respectively attached to the two pouches for holding the lower portions of the two pouches together, said second fastening means comprising two pairs of tongues respectively disposed on opposite sides of said bag, the two tongues of each pair being two-ended and respectively attached at both ends to lower portions of the rear side edges of the two pouches and being threaded through a common ring link to hold the two pouches together, each of said tongues having at least one end attached by releasable means to its associated pouch.

9. A travel bag as defined in claim 8, wherein said first fastening means further comprises two cooperating flexible fastening strips respectively comprising a multiplicity of flexible loops and a multiplicity of flexible hooks releasably engageable with said loops, said strips being respectively mounted on facing surface portions of said pouches adjacent the top thereof for engagement with each other.

10. A travel bag comprising two structurally independent and separately usable pouches securely yet detachably interconnected in back-to-back relation to each other by interengageable fastening means respectively attached to the two pouches, wherein said fastening means comprises a first strip of flexible loops and a second strip of flexible hooks releasably interengageable with said loops, respectively mounted on facing portions of said pouches for engagement with each other; wherein each of said pouches has an inner surface; and further including a pair of bands respectively having means manually applicable to said strips for engaging and covering said strips when said pouches are separated, and means disposed on said inner surfaces of said pouches for respectively releasably carrying said bands such that the bands can be manually removed from the pouch inner surfaces and applied to the strips upon separation of the pouches.

11. A travel bag comprising two structurally independent and separately usable pouches securely yet detachably interconnected in back-to-back relation to each other by interengageable fastening means respectively attached to the two pouches, wherein said fastening means includes a pair of straps attached to one of said pouches respectively adjacent opposite sides of the top thereof, and releasably attached to the other of said pouches respectively adjacent opposite sides of the top thereof; and wherein said fastening means further includes two pairs of tongues respectively disposed on opposite sides of said bag, the two tongues of each pair being two-ended and respectively attached at both ends to lower portions of the rear side edges of the two pouches and being threaded through a common ring link to hold the two pouches together, each of said tongues having at least one end attached by releasable means to its associated pouch.

12. A travel bag as defined in claim 11, wherein said fastening means further comprises two cooperating flexible fastening strips respectively comprising a multiplicity of flexible loops and a multiplicity of flexible hooks releasably engageable with said loops, said strips being respectively mounted on facing surface portions of said pouches adjacent the top thereof for engagement with each other.

* * * * *